US011450964B2

(12) United States Patent
Jeong et al.

(10) Patent No.: US 11,450,964 B2
(45) Date of Patent: Sep. 20, 2022

(54) ANTENNA ASSEMBLY WITH A CONDUCTIVE CAGE

(71) Applicant: Qualcomm Incorporated, San Diego, CA (US)

(72) Inventors: Seong Heon Jeong, Tuscaloosa, AL (US); Mohammad Ali Tassoudji, San Diego, CA (US); Jeremy Darren Dunworth, La Jolla, CA (US); Jon Lasiter, Stockton, CA (US); Ravindra Vaman Shenoy, Dublin, CA (US)

(73) Assignee: QUALCOMM Incorporated, San Diego, CA (US)

( * ) Notice: Subject to any disclaimer, the term of this patent is extended or adjusted under 35 U.S.C. 154(b) by 0 days.

(21) Appl. No.: 17/016,196

(22) Filed: Sep. 9, 2020

(65) Prior Publication Data

US 2022/0077586 A1 Mar. 10, 2022

(51) Int. Cl.

| | |
|---|---|
| ***H01Q 9/04*** | (2006.01) |
| ***H01Q 1/24*** | (2006.01) |
| ***H01Q 1/38*** | (2006.01) |
| ***H01Q 21/24*** | (2006.01) |

(52) U.S. Cl.

CPC ..... *H01Q 9/0421* (2013.01); *H01Q 1/243* (2013.01); *H01Q 1/38* (2013.01); *H01Q 21/24* (2013.01)

(58) Field of Classification Search

CPC ..... H01Q 9/04; H01Q 9/0421; H01Q 9/0428; H01Q 9/0435; H01Q 9/045; H01Q 9/0457; H01Q 9/0464; H01Q 1/24; H01Q 1/243; H01Q 1/38; H01Q 21/24

See application file for complete search history.

(56) References Cited

U.S. PATENT DOCUMENTS

| | | | |
|---|---|---|---|
| 6,052,098 | A | 4/2000 | Killen et al. |
| 6,195,062 | B1 | 2/2001 | Killen et al. |
| 6,342,866 | B1 | 1/2002 | Ho et al. |
| 6,407,717 | B2 | 6/2002 | Killen et al. |
| 7,365,698 | B2 | 4/2008 | Dwyer et al. |
| 7,683,849 | B2 | 3/2010 | Schadler et al. |
| 8,319,688 | B2 | 11/2012 | Parsche |
| 8,350,774 | B2 | 1/2013 | Pickles |
| 8,643,554 | B1 | 2/2014 | Manry, Jr. et al. |
| 9,331,388 | B2 * | 5/2016 | Lindenmeier ..... H01Q 7/00 |

(Continued)

OTHER PUBLICATIONS

International Search Report and Written Opinion—PCT/US2021/045161—ISA/EPO—dated Nov. 19, 2021.

*Primary Examiner* — Thai Pham
(74) *Attorney, Agent, or Firm* — Qualcomm Incorporated

(57) ABSTRACT

An apparatus is disclosed for an antenna with a conductive cage. In an example aspect, the apparatus includes a ground plane with at least one opening. The apparatus also includes at least one antenna assembly with at least one radiating element, at least one feed via, and a conductive cage. The radiating element is implemented on a first plane that is substantially parallel to the ground plane. The feed via is connected to the at least one radiating element and is configured to connect to at least one transmission line through the opening. The conductive cage includes at least three ground vias, which are connected to the ground plane at positions that are distributed around the opening. Lengths of the at least three ground vias extend a portion of a distance between the ground plane and the radiating element.

30 Claims, 8 Drawing Sheets

(56) References Cited

U.S. PATENT DOCUMENTS

| | | | | |
|---|---|---|---|---|
| 9,425,495 | B2 | 8/2016 | Walker | |
| 10,886,621 | B2 | 1/2021 | Tanaka et al. | |
| 2015/0123868 | A1* | 5/2015 | Bit-Babik | H01Q 9/0464 343/857 |
| 2015/0123869 | A1* | 5/2015 | Bit-Babik | H01Q 19/10 343/857 |
| 2015/0155630 | A1* | 6/2015 | Jiang | H01Q 9/36 343/700 MS |
| 2018/0040955 | A1 | 2/2018 | Vouvakis et al. | |
| 2018/0277956 | A1* | 9/2018 | Zhang | H01Q 21/06 |
| 2019/0123425 | A1 | 4/2019 | Jeong et al. | |
| 2019/0181547 | A1* | 6/2019 | Shaw | H01Q 1/50 |
| 2019/0207323 | A1 | 7/2019 | Joung et al. | |
| 2019/0252800 | A1 | 8/2019 | Yetisir et al. | |
| 2020/0006846 | A1* | 1/2020 | Lasiter | H01Q 1/2283 |
| 2020/0176892 | A1 | 6/2020 | Wang et al. | |
| 2021/0175636 | A1 | 6/2021 | Lasiter | |

* cited by examiner

ANTENNA ASSEMBLY WITH A CONDUCTIVE CAGE

TECHNICAL FIELD

This disclosure relates generally to wireless communication and, more specifically, to an antenna assembly with a conductive cage.

BACKGROUND

To increase transmission rates and throughput, cellular and other wireless networks are using signals with higher frequencies and smaller wavelengths. As an example, $5^{th}$ generation (5G)-capable devices or next-generation wireless local area network (WLAN)-capable devices communicate with networks using frequencies that include those at or near the extremely-high frequency (EHF) spectrum (e.g., frequencies greater than 24 gigahertz (GHz)) with wavelengths at or near millimeter wavelengths (mmW). However, these signals present various technological challenges, such as higher path loss as compared to signals for earlier generations of wireless communications. In certain scenarios, it can be difficult for a mmW wireless signal to travel far enough to make cellular or WLAN communications feasible at these higher frequencies.

SUMMARY

An apparatus is disclosed that implements an antenna assembly with a conductive cage, one or more feeds, and a radiating element. The conductive cage is composed of a conductive material and may include at least three ground vias, which are connected to a ground plane and are distributed around at least one opening within the ground plane. The feed passes though the opening in the ground plane and connects to the radiating element, e.g., at an upper dielectric layer. During operation, the propagation of an electrical signal through the feed can generate undesired electromagnetic radiation. The conductive cage operates as a Faraday cage and suppresses this undesired electromagnetic radiation. In this way, the conductive cage can isolate the antenna assembly from other adjacent antenna assemblies within an antenna array, suppress undesired radiation modes, and/or suppress coupling between the feed and other components within the apparatus.

In an example aspect, an apparatus is disclosed. The apparatus includes a ground plane and at least one antenna assembly. The ground plane has at least one opening. The at least one antenna assembly includes at least one radiating element, at least one feed via, and a conductive cage. The at least one radiating element is implemented on a first plane that is substantially parallel to the ground plane. The at least one feed via is connected to the at least one radiating element and is configured to connect to at least one transmission line through the at least one opening. The conductive cage includes at least three ground vias, which are connected to the ground plane at positions that are distributed around the at least one opening. Lengths of the at least three ground vias extend a portion of a distance between the ground plane and the at least one radiating element.

In an example aspect, an apparatus is disclosed. The apparatus includes grounding means for providing a connection to a ground. The grounding means includes at least one opening. The apparatus also includes communication means for transmitting or receiving a wireless communication signal. The communication means includes radiating means for converting between an electrical signal and electromagnetic energy. The electrical signal and the electromagnetic energy are associated with the wireless communication signal. The communication means also includes feeding means for passing the electrical signal through the at least one opening of the grounding means and through multiple dielectric layers of the communication means. The feeding means is connected to the radiating means. The communication means additionally includes conductive means for attenuating electromagnetic radiation generated by the feeding means. The conductive means is distributed around the at least one opening and implemented within a portion of the multiple dielectric layers. The conductive means is connected to the grounding means.

In an example aspect, a method for operating an antenna assembly with a conductive cage is disclosed. The method includes generating a wireless communication signal. The method also includes passing, using a feed, the wireless communication signal through an opening of a ground plane to a radiating element of an antenna assembly. The method additionally includes transmitting, using the radiating element, the wireless communication signal. The method further includes attenuating, using a conductive cage of the antenna assembly that is connected to the ground plane and distributed around the opening of the ground plane, electromagnetic radiation generated by the passing of the wireless communication signal to the radiating element.

DETAILED DESCRIPTION

Cellular and other wireless communications can use signals with higher frequencies and smaller wavelengths to increase transmission rates and throughput. Signals within the extremely-high frequency (EHF) spectrum (e.g., frequencies greater than 24 gigahertz (GHz)) with wavelengths at or near millimeter wavelengths (mmW), however, experience higher path loss compared to signals at lower frequency ranges. As such, it can be difficult for a mmW wireless signal to travel far enough to make cellular or WLAN communications feasible at these higher frequencies.

To address this issue, some electronic devices employ beamforming techniques to increase signal strength or sensitivity in a particular spatial direction. Beamforming techniques adjust amplitudes and/or phases of signals that are transmitted or received via different antennas of an antenna array. These adjustments determine a constructive and destructive interference pattern that occurs once the signals are combined over-the-air or within a wireless transceiver. For an angular direction at which the constructive interference occurs, a signal-to-noise ratio of the combined signals is increased at that angular direction. Applying beamforming techniques to mmW signals can therefore concentrate energy in a particular direction to compensate for the higher path loss. In this way, the electronic device can communicate with other devices over farther distances.

There are challenges to using an antenna array and beamforming, however. One such challenge is the coupling (or interference) between adjacent antennas within the antenna array. This coupling can distort the intended radiation pattern and make it challenging for the electronic device to communicate over farther distances. Additionally, radiation modes supported by the undesired coupling can propagate in undesired directions and appear as interference to other components within the electronic device.

To address this challenge, an apparatus is disclosed that implements an antenna assembly with a conductive cage, one or more feeds, and a radiating element. The conductive cage is composed of a conductive material and may include at least three ground vias, which are connected to a ground plane and are distributed around at least one opening within the ground plane. The feed passes though the opening in the ground plane and connects to the radiating element, e.g., at an upper dielectric layer. During operation, the propagation of an electrical signal through the feed can generate undesired electromagnetic radiation. The conductive cage operates as a Faraday cage and suppresses this undesired electromagnetic radiation. In this way, the conductive cage can isolate the antenna assembly from other adjacent antenna assemblies within an antenna array, suppress undesired radiation modes, and/or suppress coupling between the feed and other components within the apparatus.

Figure 1:
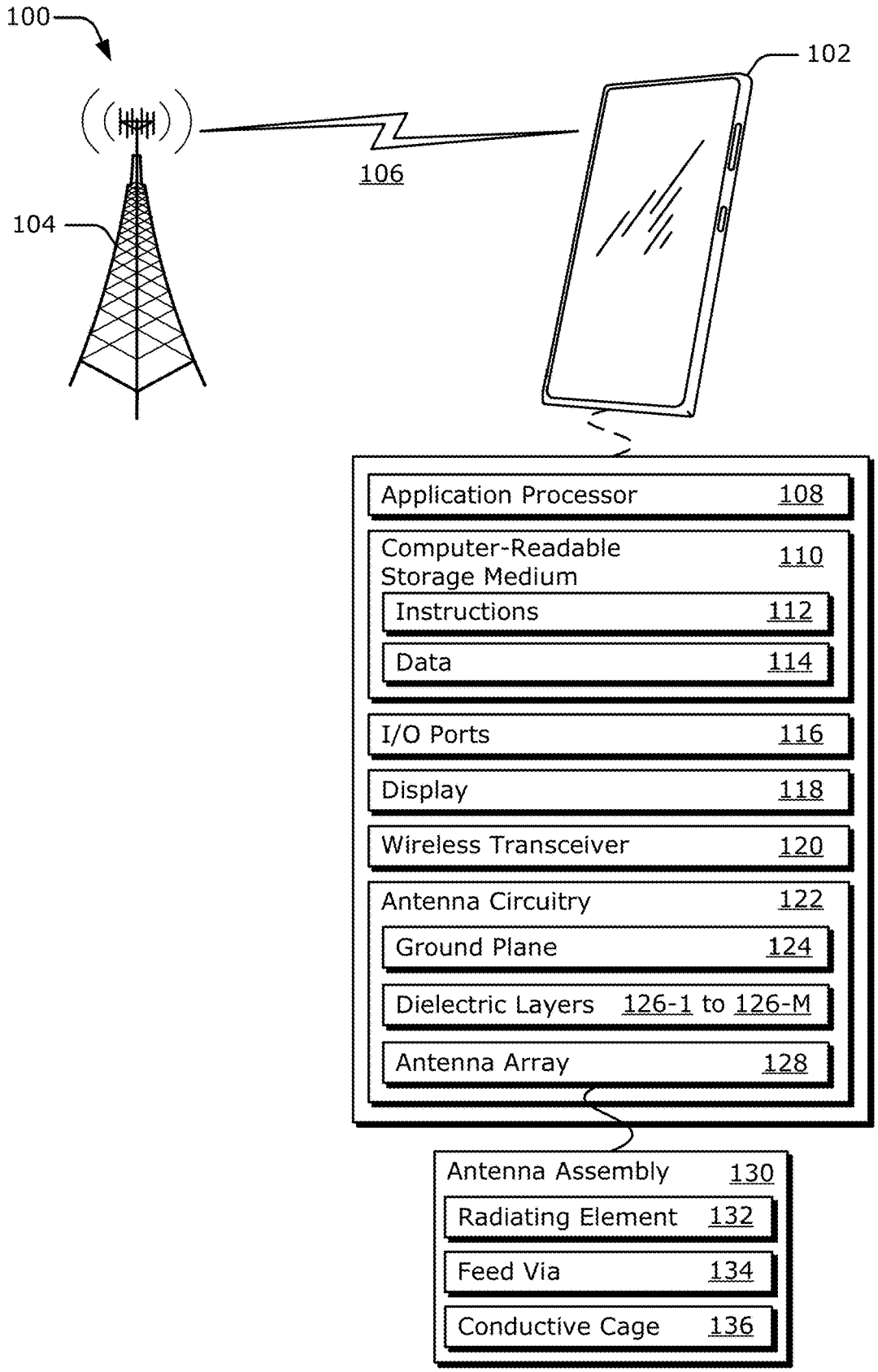
FIG. 1 illustrates an example operating environment for an antenna assembly with a conductive cage.

FIG. 1 illustrates an example environment 100 for operating an antenna assembly with a conductive cage. In the environment 100, a computing device 102 communicates with a base station 104 through a wireless communication link 106 (wireless link 106). In this example, the computing device 102 is depicted as a smartphone. However, the computing device 102 can be implemented as any suitable computing or electronic device, such as a modem, a cellular base station, a broadband router, an access point, a cellular phone, a gaming device, a navigation device, a media device, a laptop computer, a desktop computer, a tablet computer, a wearable computer, a server, a network-attached storage (NAS) device, a smart appliance or other internet of things (IoT) device, a medical device, a vehicle-based communication system, a radar, a radio apparatus, and so forth.

The base station 104 communicates with the computing device 102 via the wireless link 106, which can be implemented as any suitable type of wireless link. Although depicted as a tower of a cellular network, the base station 104 can represent or be implemented as another device, such as a satellite, a server device, a terrestrial television broadcast tower, an access point, a peer-to-peer device, a mesh network node, a fiber optic line, and so forth. Therefore, the computing device 102 may communicate with the base station 104 or another device via a wired connection, a wireless connection, or a combination thereof.

The wireless link 106 can include a downlink of data or control information communicated from the base station 104 to the computing device 102, an uplink of other data or control information communicated from the computing device 102 to the base station 104, or both a downlink and an uplink. The wireless link 106 can be implemented using any suitable communication protocol or standard, such as 2nd-generation (2G), 3rd-generation (3G), 4th-generation (4G), or 5th-generation (5G) cellular; IEEE 802.11 (e.g., Wi-Fi™); IEEE 802.15 (e.g., Bluetooth™); IEEE 802.16 (e.g., WiMAX™); and so forth. In some implementations, the wireless link 106 may wirelessly provide power and the base station 104 may comprise a power source.

As shown, the computing device 102 includes an application processor 108 and a computer-readable storage medium 110 (CRM 110). The application processor 108 can include any type of processor, such as a multi-core processor, that executes processor-executable code stored by the CRM 110. The CRM 110 can include any suitable type of data storage media, such as volatile memory (e.g., random access memory (RAM)), non-volatile memory (e.g., Flash memory), optical media, magnetic media (e.g., disk), and so forth. In the context of this disclosure, the CRM 110 is implemented to store instructions 112, data 114, and other information of the computing device 102, and thus does not include transitory propagating signals or carrier waves.

The computing device 102 can also include input/output ports 116 (I/O ports 116) and a display 118. The I/O ports 116 enable data exchanges or interaction with other devices, networks, or users. The I/O ports 116 can include serial ports (e.g., universal serial bus (USB) ports), parallel ports, audio ports, infrared (IR) ports, user interface ports such as a touchscreen, and so forth. The display 118 presents graphics of the computing device 102, such as a user interface associated with an operating system, program, or application. Alternatively or additionally, the display 118 can be implemented as a display port or virtual interface, through which graphical content of the computing device 102 is presented.

A wireless transceiver 120 of the computing device 102 provides connectivity to respective networks and/or other electronic devices. Alternatively or additionally, the computing device 102 can include a wired transceiver, such as an Ethernet or fiber optic interface for communicating over a local network, intranet, or the Internet. The wireless transceiver 120 can facilitate communication over any suitable type of wireless link or network, such as a wireless local area network (WLAN), peer-to-peer (P2P) network, mesh network, cellular network, wireless wide-area-network (WWAN), and/or wireless personal-area-network (WPAN). In the context of the example environment 100, the wireless transceiver 120 enables the computing device 102 to communicate with the base station 104 and networks connected therewith. However, the wireless transceiver 120 can also enable the computing device 102 to communicate "directly" with other devices and/or networks.

The wireless transceiver 120 includes circuitry and logic for transmitting and receiving communication signals via the antenna circuitry 122. Components of the wireless transceiver 120 can include amplifiers, switches, mixers, analog-to-digital converters, filters, and so forth for conditioning the communication signals (e.g., for generating or processing signals). The wireless transceiver 120 can also include logic to perform in-phase/quadrature (I/Q) operations, such as synthesis, encoding, modulation, decoding, demodulation, and so forth. In some cases, components of the wireless transceiver 120 are implemented as separate transmitter and receiver entities. Additionally or alternatively, the wireless transceiver 120 can be realized using multiple or different sections to implement respective transmitting and receiving operations (e.g., separate transmit and receive chains). In general, the wireless transceiver 120 processes data and/or signals associated with communicating data of the computing device 102 using the antenna circuitry 122.

Although not explicitly depicted, the computing device 102 can include another processor, which is coupled to the wireless transceiver 120. The processor, which may comprise a modem, can be implemented within or separate from the wireless transceiver 120. The processor can include a portion of the CRM 110 or can access the CRM 110 to obtain computer-readable instructions. The processor controls the wireless transceiver 120 and enables wireless communication to be performed. The processor can include baseband circuitry to perform high-rate sampling processes that can include analog-to-digital conversion, digital-to-analog conversion, gain correction, skew correction, frequency translation, and so forth. The processor can provide communication data to the wireless transceiver 120 for transmission and process a baseband version of a received signal, which is provided by the wireless transceiver 120. The processor can generate data, which can be provided to other parts of the computing device 102 via a communication interface.

The antenna circuitry 122 can be implemented, for example, on a printed circuit board or laminated substrate, which can be rigid or flexible. In some embodiments, some or all of the elements of the antenna circuitry 122 are included in a module separate from one or more other elements, such as the wireless transceiver 120, of the computing device 102. In the depicted configuration, the antenna circuitry 122 includes at least one ground plane 124 and multiple dielectric layers 126-1 to 126-M, which are vertically stacked together in relation to (e.g., "above") the ground plane 124. The variable M represents a positive integer that is greater than one. The dielectric layers 126-1 to 126-M can be laminated together. In some implementations, the dielectric layers 126-1 to 126-M have similar thicknesses and permittivities. In other implementations, the dielectric layers 126-1 to 126-M have different thicknesses and/or different permittivities. In some cases, dielectric constants of the dielectric layers 126-1 to 126-M are larger relative to other designs to enable the antenna circuitry 122 to have a smaller footprint. As an example, the dielectric layers 126-1 to 126-M can have a dielectric constant of six.

The antenna circuitry 122 can have a symmetric or asymmetric construction. With the symmetric construction, a similar quantity of dielectric layers 126 are implemented on both sides of (e.g., both above and below) a core layer (shown in FIG. 2) of the printed circuit board. With the asymmetric construction, different quantities of dielectric layers 126 are implemented above and below the core layer. Although the symmetric construction can help reduce warping and twisting during assembly, the asymmetric construction can enable the antenna circuitry 122 to have a smaller thickness relative to the symmetric construction. This enables the antenna circuitry 122 to be implemented in space-constrained computing devices 102.

Figure 2:
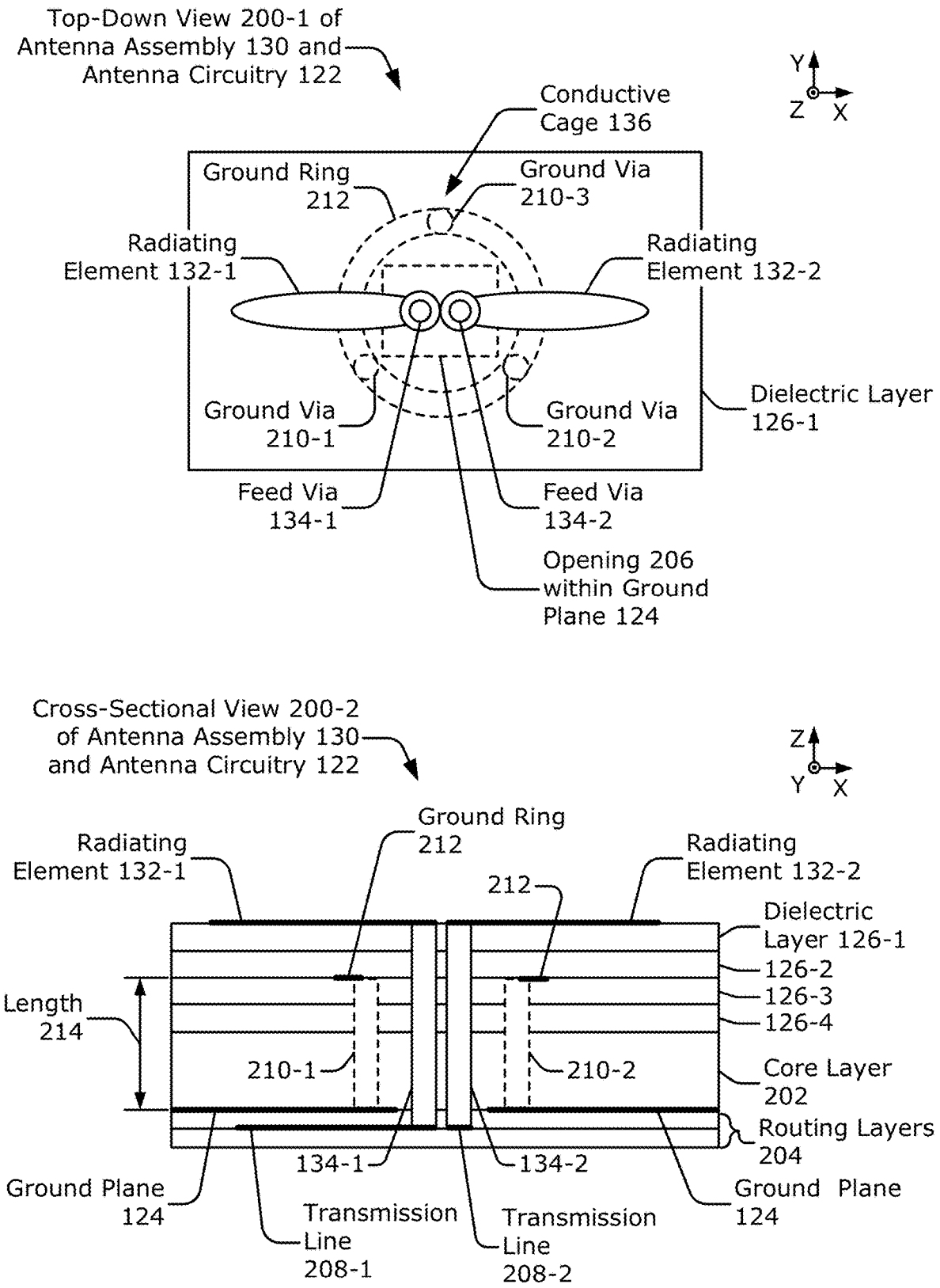
FIG. 2 illustrates an example implementation of an antenna assembly with a conductive cage.

The ground plane 124 is connected to a DC ground and is stacked above one or more routing layers (shown in FIG. 2). The ground plane 124 includes at least one opening (shown in FIG. 2) to enable signals to propagate from the routing layers below the ground plane 124 to the dielectric layers 126-1 to 126-M above the ground plane 124.

The antenna circuitry 122 also includes at least one antenna, which is implemented on the dielectric layers 126-1 to 126-M above the ground plane 124. The antenna may be included in an antenna array 128 having multiple antenna assemblies 130. The antenna assemblies 130 represent different antennas or antenna elements of the antenna array 128. A variety of different types of antennas can be implemented using the antenna assemblies 130. Example types of antennas include a bowtie antenna, a patch antenna, an inverted-F antenna, and so forth. In some cases, pairs of antenna assemblies 130 associated with different antenna arrays 128 are positioned and oriented to implement a cross-dipole antenna, as further described with respect to FIG. 7.

In some implementations, the antenna assembly 130 has a wide bandwidth, which enables the antenna circuitry 122 to support wireless communication for a variety of different frequency bands. Such frequency bands may be used within a single country and/or may be used across different countries. As an example, the antenna assembly 130 has a bandwidth that includes frequencies between approximately 24 and 43 GHz. The use of larger bandwidth antenna assemblies 130 enables the antenna circuitry 122 to replace multiple narrowband antenna circuitry to conserve space within the computing device 102. The antenna assembly 130 can be horizontally polarized or vertically polarized depending on its orientation, as further described with respect to FIG. 5.

Each antenna assembly 130 includes at least one radiating element 132, at least one feed, and at least one conductive cage 136. The feed may be implemented as a feed via 134, described in more detail with respect to subsequent figures. The radiating element 132 is implemented using a conductive material, such as metal, which can convert electrical signals (e.g. voltages and currents) into electromagnetic energy or convert electromagnetic energy into electrical signals. The radiating element 132 can thus emit or sense electromagnetic energy. The radiating element 132 is implemented on an upper dielectric layer 126 in the illustrated embodiment.

The feed via 134 is connected to the radiating element 132 and passes electrical signals through the dielectric layers 126-1 to 126-M and the opening of the ground plane 124. These electrical signals can correspond to a wireless communication signal that is passed from the wireless transceiver 120 to the radiating element 132 during transmission or can correspond to another wireless communication signal that is received by the radiating element 132 and passed to the wireless transceiver 120 during reception. In some implementations, there can be individual openings within the ground plane 124 for each feed via 134 of the antenna assembly 130. In other implementations, a single opening within the ground plane 124 can be large enough for two or more feed vias 134 of the antenna assembly 130 to pass through.

While passing the electrical signals, e.g. voltage and current, the feed via 134 generates undesired electromagnetic radiation. Left unchecked, this electromagnetic radiation can distort the intended radiation pattern of the antenna array 128, propagate in undesired directions, and interact with other components within the computing 102, including coupling to other antenna assemblies.

The conductive cage 136 is connected to the ground plane 124 and implemented using conductive material. At least a portion of the conductive cage 136 is implemented within (e.g. inside) one or more of the dielectric layers 126-1 to 126-M. In some implementations, another portion of the conductive cage 136 can be implemented on a surface of one or more of the dielectric layers 126-1 to 126-M. The conductive cage 136 operates as a Faraday cage (e.g., a shield), which attenuates the undesired electromagnetic radiation and/or coupling to other components. In this manner, the conductive cage 136 can substantially isolate the antenna assembly 130 from other adjacent antenna assemblies 130 within the antenna array 128. The conductive cage 136 is further described with respect to FIG. 2.

FIG. 2 illustrates an example implementation of the antenna assembly 130 with the conductive cage 136. A top-down view 200-1 of the antenna assembly 130 and the antenna circuitry 122 is shown at the top of FIG. 2. The top-down view 200-1 is shown with respect to a horizontal X axis, a vertical Y axis, and a Z axis that goes into and out of the page. A cross-sectional view 200-2 is shown at the bottom of FIG. 2. The cross-sectional view 200-2 is shown with respect to a horizontal X axis, a vertical Z axis, and the Y axis, which goes into and out of the page. For simplicity, the cross-sectional view 200-2 illustrates a cut-away portion of the antenna assembly 130 taken along a horizontal X axis that passes through the radiating elements 132-1 and 132-2.

As seen in the cross-sectional view 200-2, the antenna circuitry 122 includes the dielectric layers 126-1 to 126-4 (e.g., M equals 4 here), a core layer 202, the ground plane 124, and one or more routing layers 204. In general, the dielectric layers 126-1 to 126-4, the core layer 202, the ground plane 124, and the routing layers 204 are substantially parallel to each other. The surfaces of the dielectric layers 126-1 to 126-4 can be implemented along respective planes. As depicted, the ground plane 124 is stacked on top of the routing layers 204, the core layer 202 is stacked on top of the ground plane 124, and the dielectric layers 126-1 to 124-4 are stacked together on top of the core layer 202. In this example, the dielectric layers 126 have a same dielectric constant of 6. The antenna circuitry 122 has an asymmetric construction, which reduces a thickness of the antenna circuitry 122.

In the depicted configuration, the antenna assembly 130 implements a bowtie antenna with a first radiating element 132-1 and a second radiating element 132-2 implemented on the top dielectric layer 126-1. The first radiating element 132-1 and the second radiating element 132-2 are configured in a bowtie shape. The antenna assembly 130 also includes a first feed via 134-1 and a second feed via 134-2. Lengths of the radiating elements 132-1 and 132-2 along the X axis can be similar to heights of the feed vias 134-1 and 134-2 along the Z axis. In other implementations, the radiating elements 132-1 and 132-2 could be placed on top of dielectric layer 126-2 and below dielectric layer 126-1. While a bowtie antenna is illustrated herein, other types of antennas may be implemented. For example, a dipole antenna having relatively thin, straight conductors may be used, or a monopole antenna may be used. In other embodiments, a patch antenna may be implemented. Depending on the type of antenna or radiating element, more (e.g., four) or fewer (i.e., one) feed vias 134 may be used.

As seen in the cross-sectional view 200-2, the feed vias 134-1 and 134-2 pass through the dielectric layers 126-1 to 126-4 and an opening 206 within the ground plane 124 to respectively connect the radiating elements 132-1 and 132-2 to transmission lines 208-1 and 208-2, which are implemented within the routing layers 204. Although not explicitly shown, the transmission lines 208-1 to 208-2 are connected to the wireless transceiver 120 of FIG. 1. In some implementations, a shape of the opening 206 is rectangular, as shown in the top-down view 200-1. In other implementations, the shape of the opening 206 can be circular or another type of shape, such as a polygon, circle, or oval.

The conductive cage 136 includes at least three ground vias 210, such as ground vias 210-1, 210-2, and 210-3. As seen in the cross-sectional view 200-2, the ground vias 210-1 to 210-3 are connected to the ground plane 124 and extend through a portion of the dielectric layers 126-1 to 126-4. For example, in FIG. 2, lengths 214 of the ground vias 210-1 to 210-3 extend through the dielectric layers 126-3 and 126-4 as well as the core layer 202. In general, the lengths 214 of the ground vias 210-1 to 210-3 are chosen to provide a target amount of isolation.

Increasing a ratio of the lengths 214 of the ground vias 210-1 to 210-3 to a distance between the ground plane 124 and the radiating element 132-1 or 132-2 enhances the ability of the conductive cage 136 to isolate the antenna assembly 130 from other adjacent antenna assemblies, suppress undesired radiation modes, and/or suppress coupling between the feed vias 134-1 and 134-2 and other components within the computing device 102. In example implementations, this ratio can be greater than or equal to 0.25 (e.g., approximately equal to 0.25, 0.5, 0.625, or 0.75). In a particular implementation, the lengths 214 of the ground vias 210-1 to 210-3 are approximately equal to 700 micrometers and the distance between the ground plane 124 and the radiating element 132-1 or 132-2 is approximately equal to 1000 micrometers.

As shown in the top-down view 200-1, the ground vias 210-1 to 210-3 are distributed around the opening 206 (e.g., distributed around a center of the opening 206). In this way, the conductive cage 136 surrounds the opening 206 and therefore surrounds the feed vias 134-1 and 134-2.

Horizontal distances between the ground vias 210-1 to 210-3 and the center of the opening 206 can be optimized based on the size of the radiating elements 132-1 to 132-2 to realize a target impedance for the antenna assembly 130. In general, components of the conductive cage 136 do not extend beyond a length (e.g., an outermost or distal point) of the radiating elements 132-1 to 132-2. The ground vias 210-1 to 210-3 can be evenly or unevenly distributed around the center of the opening 206. As an example, the ground vias 210-1 to 210-3 are evenly distributed at 120 degree increments around the center of the opening 206, as shown in FIG. 2. In some implementations, the conductive cage 136 includes more than three ground vias 210, such as four, six, eight, sixteen, and so forth. Increasing the quantity of ground vias 210 can improve the ability of the conductive cage 136 to provide isolation for the antenna assembly 130.

The conductive cage 136 can also include a ground ring 212, which connects the ground vias 210-1 to 210-3 together. This effectively shorts the far ends of the ground vias 210-1 to 210-3 together. In this context, the far ends of the ground vias are the contact points of the vias which are farthest away from the ground plane. The ground ring 212 can be implemented on the surface of one or more of the dielectric layers 126-2 to 126-4, which are between the ground plane 124 and the radiating elements 132-1 and 132-2. In FIG. 2, the radiating elements 132-1 and 132-2 are on the top surface of the top dielectric layer 126-1. As such, the ground ring 212 can be on top of any dielectric layers 126-2 to 126-4 that is below the top dielectric layer 126-1. As seen in the cross-sectional view 200-2, the ground ring 212 is implemented on the dielectric layer 126-3 in the illustrated embodiment. The cross-sectional view 200-2 illustrates a cut-away portion of the antenna assembly 130. Consequently, only a portion of the ground ring 212 is shown in FIG. 2. It is to be understood, however, that the ground ring 212 connects to the ground vias 210-1 to 210-3 and wraps around the opening 206 within the ground plane 124 such that the ground ring 212 extends along other points on the X axis that are not shown. The ground ring 212 is implemented using a conductive material, such as metal, and is connected to the ground plane 124 through the ground vias 210-1 to 210-3.

Although described as a ring, the ground ring 212 can have any closed-form shape, including a regular shape, an irregular shape, or a shape with curves. Example shapes of the ground ring 212 include a polygon (e.g., a rectangle, a square, or a triangle), a circle, or an oval. As shown in FIG. 2, there is an opening defined by the ground ring 212, which enables the feed vias 134-1 to 134-2 to pass through.

In general, a horizontal distance between an outer edge of the ground ring 212 and the center of the opening 206 is less than a length of the radiating element 132-1 or 132-2. Consider an example in which the ground ring 212 has a circular shape with a radius. In this case, the radius of the ground ring 212 is made to be smaller than the length of the radiating element 132-1 along the X axis to prevent the ground ring 212 from extending past a furthest edge of the radiating element 132.

Although not shown in FIG. 2, some implementations of the conductive cage 136 include multiple ground rings 212, which are implemented on different dielectric layers 126. The multiple ground rings 212 can be connected together using the ground vias 210-1 to 210-3 or using other ground vias 210. For example, another ground ring 212 can be implemented on the dielectric layer 126-4 and the ground vias 210-1 to 210-3 connect this ground ring 212 to the ground ring 212 implemented on the dielectric layer 126-3. In some cases, the multiple ground rings 212 have a same shape and size (e.g., have circular shapes with a same diameter). In other cases, the multiple ground rings 212 have different shapes and/or different sizes. As an example, a ground ring 212 on the dielectric layer 126-4 can have a larger diameter than the ground ring 212 on the dielectric layer 126-3 to form a tiered or stepped conductive cage 136. In this example, a first set of ground vias 210 connects the ground ring 212 on the dielectric layer 126-4 to the ground plane 124. Additionally, a second set of ground vias 210 connects the ground ring 212 on the dielectric layer 126-4 to the ground ring 212 on the dielectric layer 126-3. Although the use of multiple ground rings 212 can increase a cost of the antenna assembly 130, the multiple ground rings 212 can enhance the ability of the conductive cage 136 to isolate the antenna assembly 130.

During operation, alternating currents flow through the feed vias 134-1 to 134-2. These alternating currents can generate a magnetic field which can couple to adjacent antenna assemblies or create electromagnetic radiation in an undesired direction. When the conductive cage 136 is present, then the magnetic field induces eddy currents within the conductive cage 136, which generates a counter-magnetic (e.g., opposing) field. The counter-magnetic field counteracts and substantially attenuates the magnetic field generated by the feed vias 134-1 and 134-2. In this way, the conductive cage 136 attenuates the coupling, undesired radiation modes, and/or potential interference generated by the feed vias 134-1 and 134-2 and/or reduces a strength of the coupling to or interference at other antenna assemblies 130 within the antenna array 128 of FIG. 1. The conductive cage 136 may also reduce the amount of radiation that propagates in undesired directions and interacts with other components within the computing device 102. Other implementations of the antenna assembly 130 are further described with respect to FIGS. 3 and 4.

Figure 3:
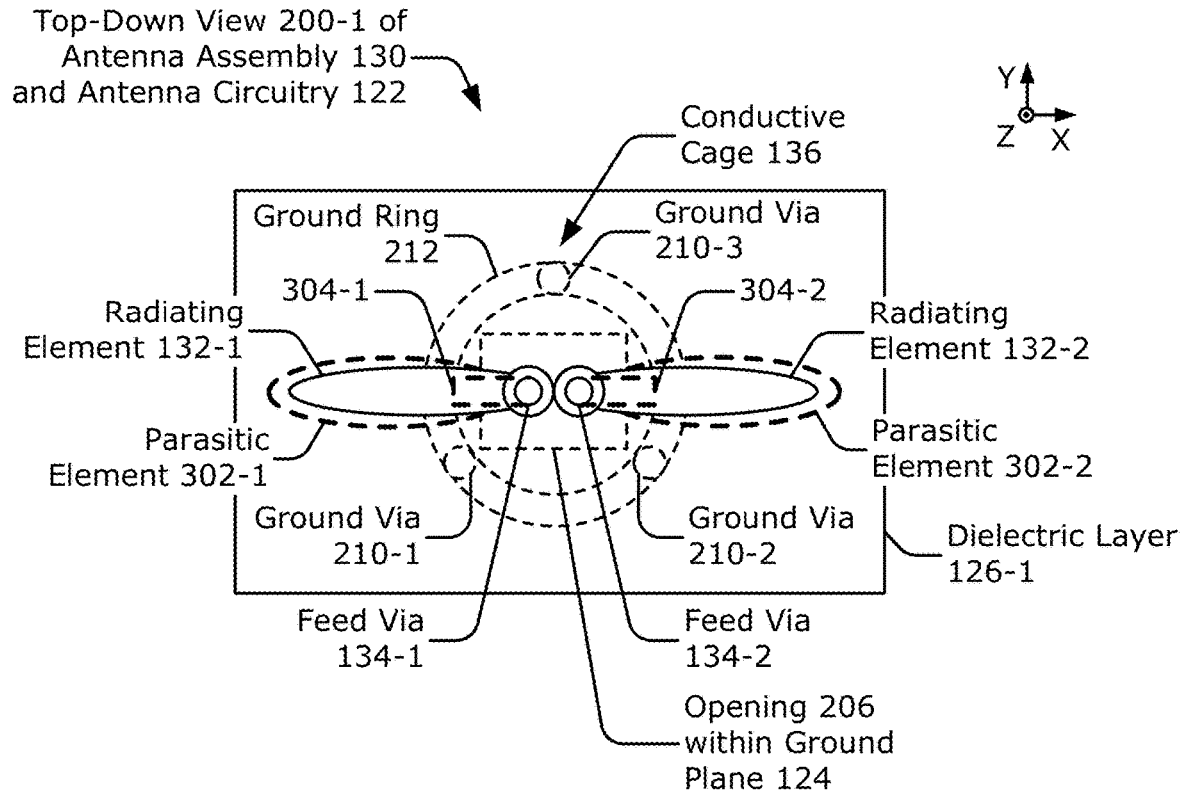
FIG. 3 illustrates another example implementation of an antenna assembly with a conductive cage.
Figure 3:
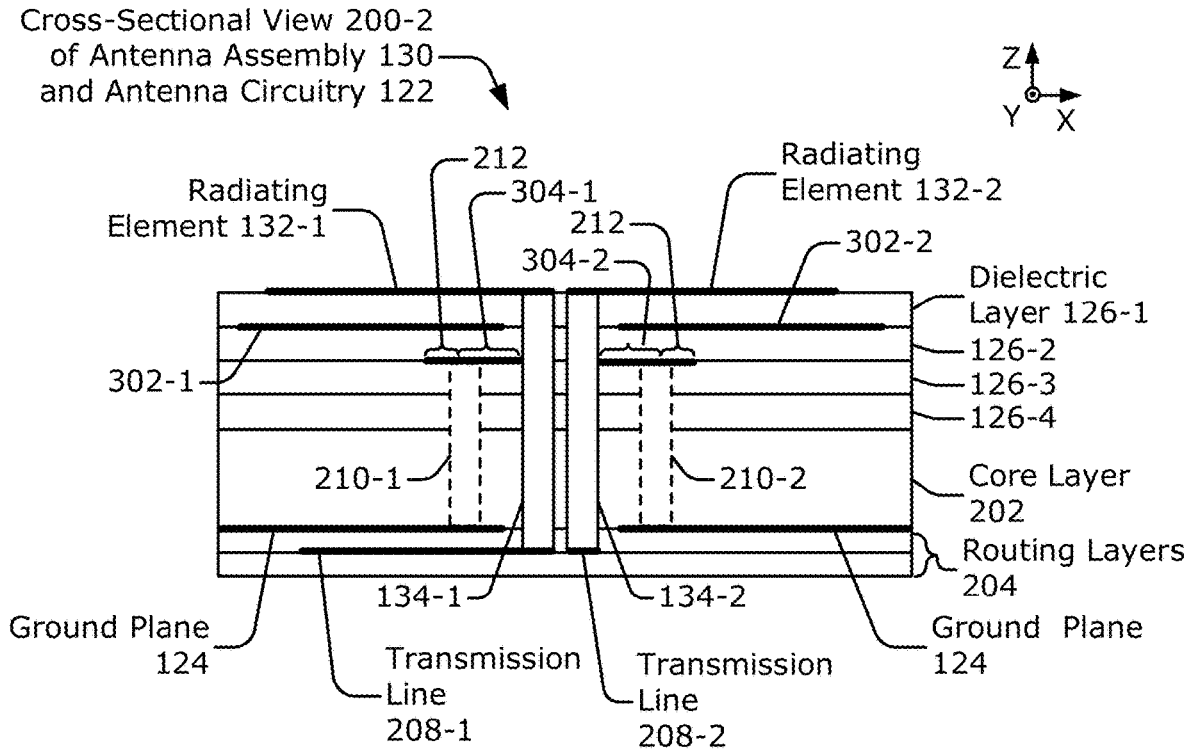

FIG. 3 illustrates another example implementation of the antenna assembly 130 with the conductive cage 136. The antenna assembly 130 of FIG. 3 is similar to the antenna assembly 130 of FIG. 2, with the addition of parasitic elements 302-1 and 302-2 and/or shorting strips 304-1 and 304-2, which are shown with thicker line widths in the top-down view 200-1. The parasitic elements 302-1 and 302-2 and the shorting strips 304-1 and 304-2 are implemented on other dielectric layers 126 that are below the top dielectric layer 126-1. Use of the parasitic elements 302-1 and 302-2 and the shorting strips 304-1 and 304-2 can tailor the performance of the antenna assembly 130, as further described below.

As seen in the cross-sectional view 200-2, the parasitic elements 302-1 and 302-2 are implemented on the dielectric layer 126-2 and are respectively positioned below the radiating elements 132-1 and 132-2. In other implementations (not shown) the parasitic element 302-1 or 302-2 includes a pair of strips, which are positioned on opposite sides of the parasitic elements 302-1 or 302-2 such that the lengths of the strips are along the X axis. The parasitic elements 302-1 and 302-2 are not directly connected to the feed vias 134-1 and 134-2 (e.g., the parasitic elements 302-1 and 302-2 are floating). In some cases, the antenna assembly 130 can include multiple parasitic elements 302 that are stacked below the radiating element 132-1 or 132-2 (e.g., that are implemented on different dielectric layers 126 that are below the top dielectric layer 126-1). The parasitic elements 302-1 and 302-2 are implemented using a conductive material, such as metal. As such, the parasitic elements 302-1 and 302-2 respond to the electromagnetic field that is transmitted or received by the radiating elements 132-1 and 132-2. In general, a size of the parasitic elements 302-1 and 302-2 can be determined to achieve a particular resonance (e.g., resonant frequency) for the antenna assembly 130. Thus, the antenna assembly 130 may include parasitic elements which are shaped similarly to the radiating elements 132, but which are relatively larger and/or smaller (depending on how many layers of parasitic elements are implemented) than the radiating elements 132. In some embodiments, several layers of progressively larger parasitic elements are implemented. While the parasitic elements 302-1 and 302-2 are illustrated as being respectively below the radiating elements 132-1 and 132-2 in the stack, one or more parasitic elements may instead or in addition be disposed above the radiating elements 132 in the stack. For example, in some embodiments, the radiating elements 132 are disposed on top of the dielectric layer 126-2 and the parasitic elements are disposed on top of the dielectric layer 126-1.

The shorting strip 304-1 is connected between the feed via 134-1 and the ground ring 212 below the radiating element 132-1. Similarly, the shorting strip 304-2 is connected between the feed via 134-2 and the ground ring 212 below the radiating element 132-2. Although not shown in FIG. 3, other implementations of the antenna assembly 130 can connect the shorting strips 304-1 and 304-2 to the ground vias 210-1 and 210-2 instead of the ground ring 212. For example, the shorting strip 304-1 can be connected between the feed via 134-1 and a point along a length 214 of the ground via 210-1. Similarly, the shorting strip 304-2 can be connected between the feed via 134-2 and another point along a length 214 of the ground via 210-2.

In general, the shorting strips 304-1 and 304-2 adjust an impedance of the antenna assembly 130 to improve performance for a target frequency band. With the shorting strips 304-1 and 304-2, the antenna assembly 130 can implement an inverted-F antenna (or an inverted-F type antenna) in some embodiments.

Figure 4:
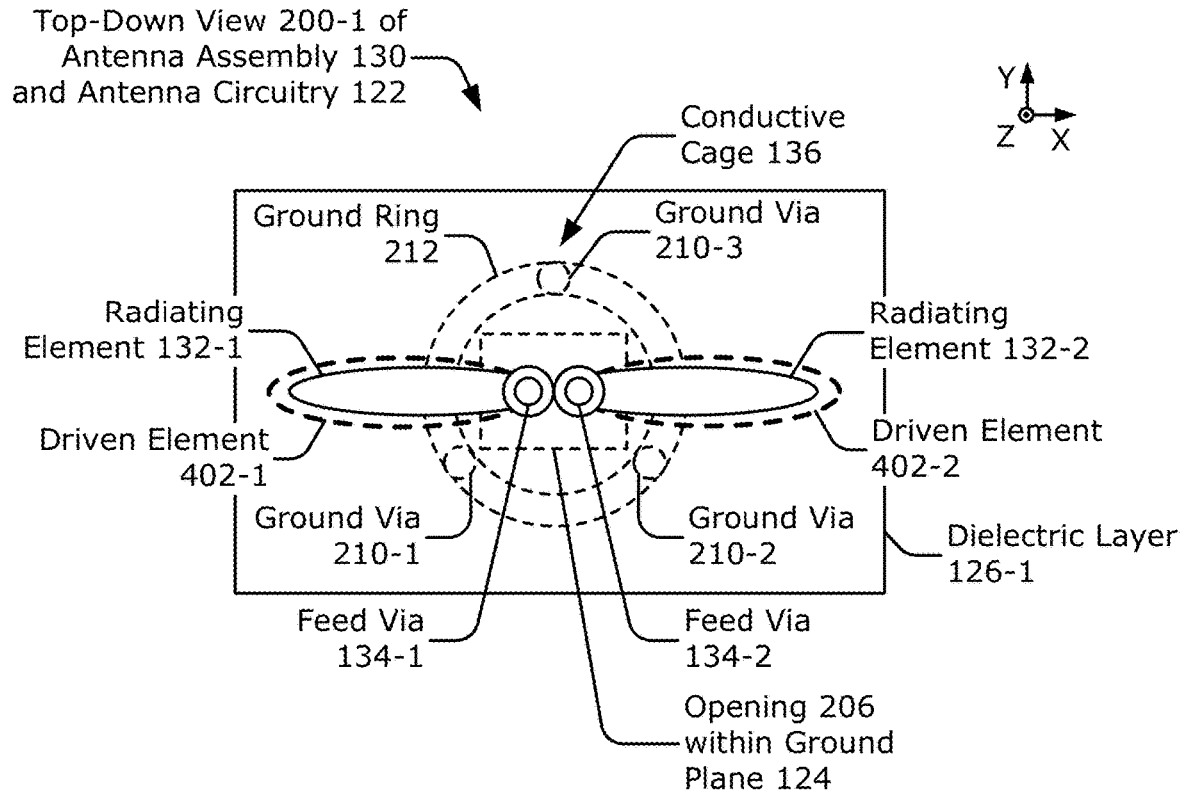
FIG. 4 illustrates yet another example implementation of an antenna assembly with a conductive cage.
Figure 4:
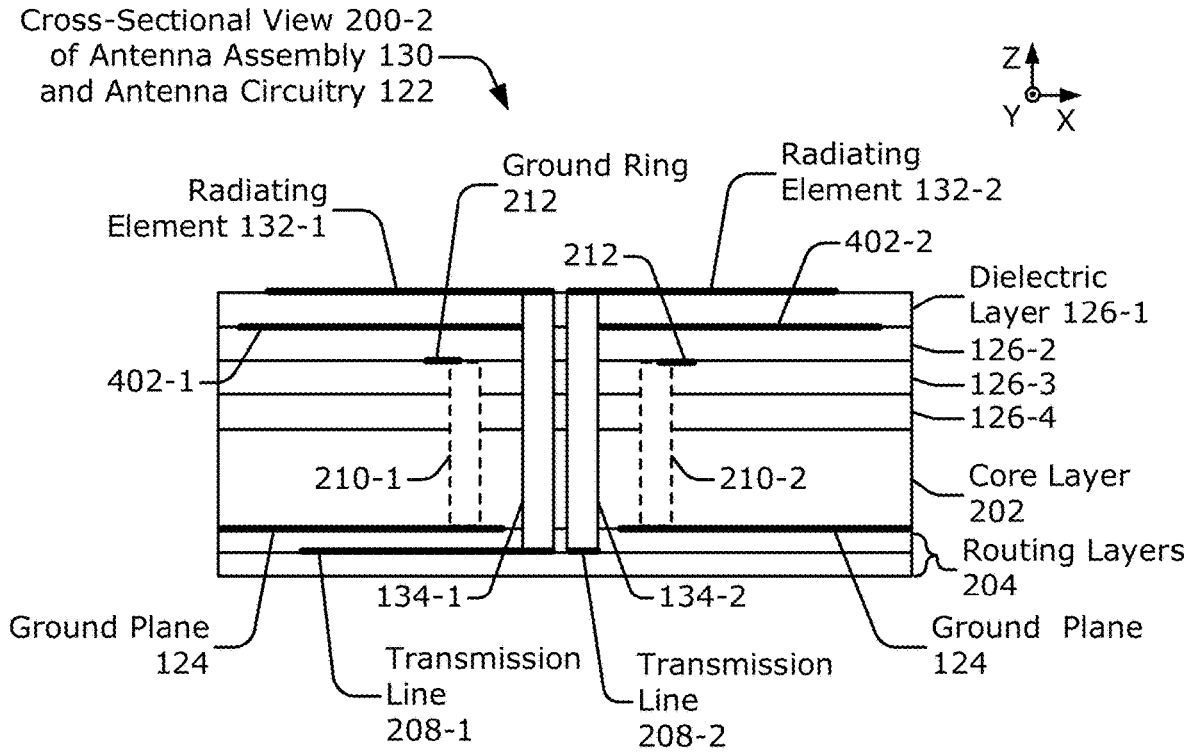

FIG. 4 illustrates another example implementation of the antenna assembly 130 with the conductive cage 136. The antenna assembly 130 of FIG. 4 is similar to the antenna assembly 130 of FIG. 2, with the addition of driven elements 402-1 and 402-2, which are shown with thicker line widths in the top-down view 200-1. The driven elements 402-1 and 402-2 are implemented on other dielectric layers 126 that are below the top dielectric layer 126-1. Use of the driven elements 402-1 and 402-2 can tailor the performance of the antenna assembly 130, as further described below.

As seen in the cross-sectional view 200-2, the driven elements 402-1 and 402-2 are implemented on the dielectric layer 126-2 and are respectively positioned below the radiating elements 132-1 to 132-2. In contrast to the parasitic elements 302-1 and 302-2 of FIG. 3, the driven elements 402-1 and 402-2 of FIG. 4 are directly connected to the feed vias 134-1 and 134-2. In some cases, the antenna assembly 130 can include multiple driven elements 402 that are stacked below the radiating element 132-1 or 132-2 (e.g., that are implemented on different dielectric layers 126 that are below the top dielectric layer 126-1). The driven elements 402-1 and 402-2 are implemented using a conductive material, such as metal, and can have similar or different shapes and sizes relative to the radiating elements 132-1 and 132-2. This enables the driven elements 402-1 and 402-2 to have a different resonance compared to the radiating elements 132-1 and 132-2. With the driven elements 402-1 and 402-2, the antenna assembly 130 can have a wider bandwidth relative to the bandwidth of the antenna assemblies 130 of FIG. 2 or 3. Although not shown, some implementations of the antenna assembly 130 of FIG. 4 can also include the parasitic elements 302-1 and 302-2 and/or the shorting strips 304-1 and 304-2 of FIG. 3

Figure 5:
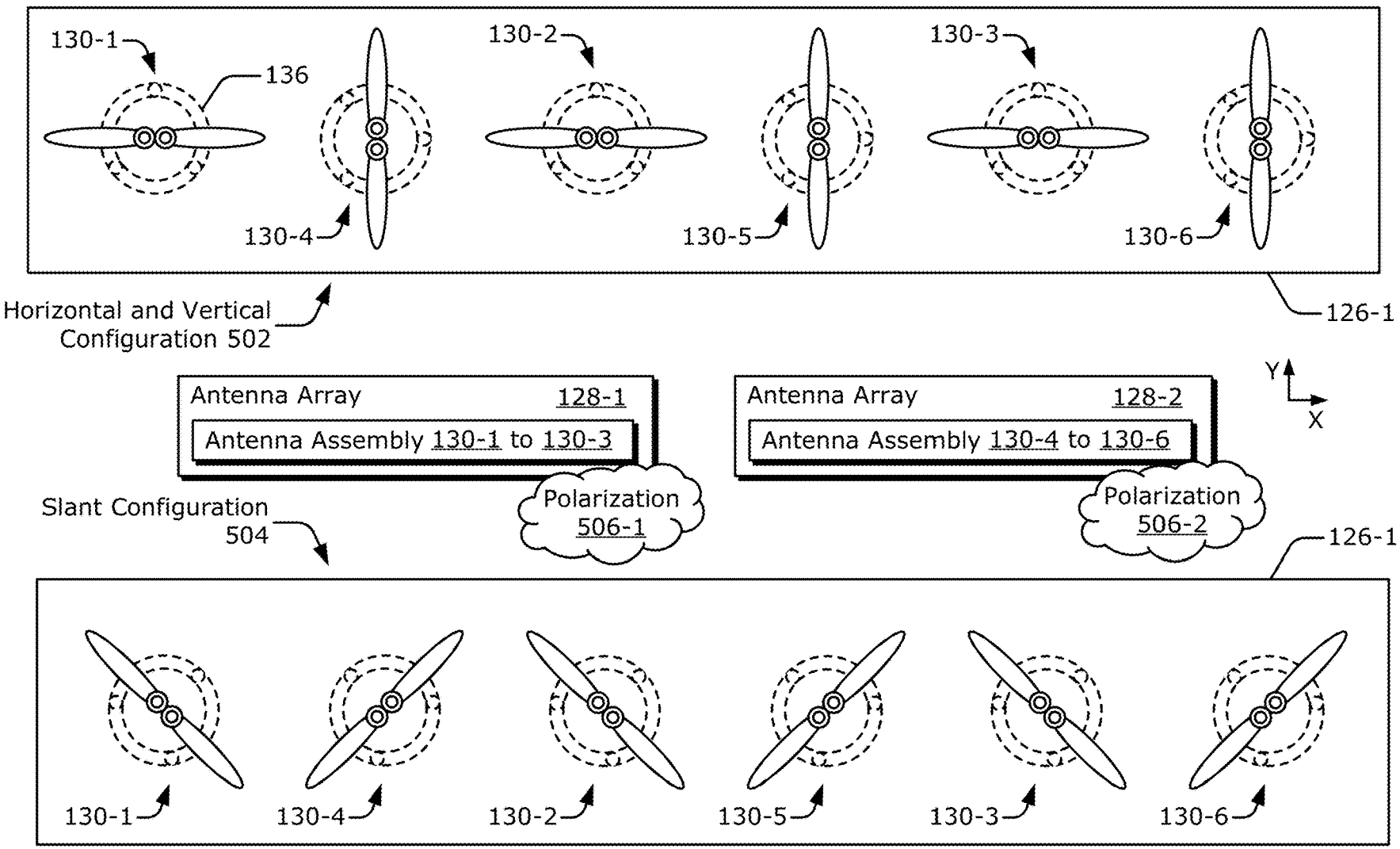
FIG. 5 illustrates example configurations of antenna arrays including antenna assemblies with conductive cages.

FIG. 5 illustrates example configurations 502 and 504 of antenna arrays 128-1 and 128-2 of the antenna circuitry 122 (of FIG. 1). The antenna arrays 128-1 and 128-2 each include multiple antenna assemblies 130 (e.g., any of the antenna assemblies 130 described above with respect to FIG. 2, 3, or 4). In some implementations, the antenna arrays 128-1 and 128-2 are implemented on a continuous ground plane 124 and continuous dielectric layers 126-1 to 126-M (of FIG. 1). In other implementations, air gaps can exist between portions of the ground plane 124 and the dielectric layers 126-1 to 126-M. Each portion is associated with a particular antenna assembly 130 within the antenna arrays 128-1 and 128-2. The air gaps, which are not shown in FIG. 5, can be rectangles with the long dimension on the rectangle running from the bottom to the top of the ground plane 124 and dielectric 126-1 to 126-M in the Y axis and the short dimension of the rectangle sized to fit between antenna assemblies 130-1 and 130-4, 130-4 and 130-2, and 130-2 and 130-5, and so on. The air gaps can include regions of the antenna circuitry 122 in which some or all of the dielectric layers 126-1 to 126-M are removed or omitted. In some cases, the air gaps also include gaps in the ground plane 124. In other cases, the air gaps represent regions in which there is a gap in some or all of the dielectric layers 126-1 to 126-M while the ground plane 124 is continuous throughout the air gaps. Separating the antenna assemblies 130 using air gaps can help mitigate the propagation of surface waves across the antenna circuitry 122.

In FIG. 5, the antenna array 128-1 includes antenna assemblies 130-1 to 130-3 and has a first polarization 506-1 based on the orientation of the antenna assemblies 130-1 to 130-3. The antenna array 128-2 includes antenna assemblies 130-4 to 130-6 and has a second polarization 506-2 based on the orientation of the antenna assemblies 130-4 to 130-6. In some implementations, the antenna arrays 128-1 and 128-2 include additional antenna assemblies 130 that are not shown in FIG. 5. In other implementations, the antenna arrays 128-1 and 128-2 include fewer antenna assemblies 130 than are shown in FIG. 5 In the configurations 502 and 504, the first polarization 506-1 is orthogonal to the second polarization 506-2, and the antenna assemblies 130-1 to 130-3 of the antenna array 128-1 are interleaved with the antenna assemblies 130-4 to 130-6 of the antenna array 128-2. Each of the antenna assemblies 130-1 to 130-6 includes its own conductive cage 136. The conductive cages 136 increase isolation between the antenna assemblies 130-1 to 130-6.

In the horizontal and vertical configuration 502, the antenna assemblies 130-1 to 130-3 of the antenna array 128-1 have radiating elements 132 that are oriented along the horizontal X axis. In contrast, the antenna assemblies 130-4 to 130-6 of the antenna array 128-2 have radiating elements 132 that are oriented along the vertical Y axis. As such, tips of the radiating elements 132 of the antenna assemblies 130-1 to 130-6 are positioned away from each other. While this can reduce coupling between the antenna assemblies 130, it can be more challenging to manufacture. In particular the antenna assemblies 130-1 to 130-3 are rotated 90 degrees with respect to the short edges of the ground plane 124 and the antenna assemblies 130-4 to 130-6 are rotated 90 degrees with respect to the long edges of the ground plane 124. This causes the horizontally polarized antenna assemblies 130-1 to 130-3 to see a different effective ground plane and boundary condition than the vertically polarized antenna assemblies 130-4 to 130-6. These differences may complicate the designs of the antenna arrays 128-1 and 128-2.

In the slant configuration 504, the antenna assemblies 130-1 to 130-3 of the antenna array 128-1 have radiating elements 132 that are oriented along a negative 45 degree angle relative to the X axis. In contrast, the antenna assemblies 130-4 to 130-6 of the antenna array 128-2 have radiating elements 132 that are oriented along a positive 45 degree angle relative to the X axis. Dimensions of the slant configuration 504 can be smaller than the dimensions of the horizontal and vertical configuration 502 along at least one of the axis (e.g., the X or Y axis). This can be advantageous for space-constrained computing devices 102. In some embodiments, a dimension of the configuration 502 or 504 measured along the Y axis is less (or substantially less) than a thickness of a computing device 102 in which the configuration is implemented. As such, the configuration may be disposed beyond a boundary of a main printed circuit board (PCB) of the computing device 102 and near an edge of the computing device 102 to allow for signals to be communicated out/into the edge. The slant configuration 504 also enables both antenna arrays 128-1 to 128-2 to observe a similar boundary condition because the tips of the radiating elements 132 of the antenna assemblies 130-1 to 130-6 are positioned along similar positions on the Y axis. Although this can increase coupling between the antenna assemblies 130-1 to 130-6, the similar boundary condition can make it easier to design and manufacture the slant configuration 504 relative to the horizontal and vertical configuration 502.

Figure 6:
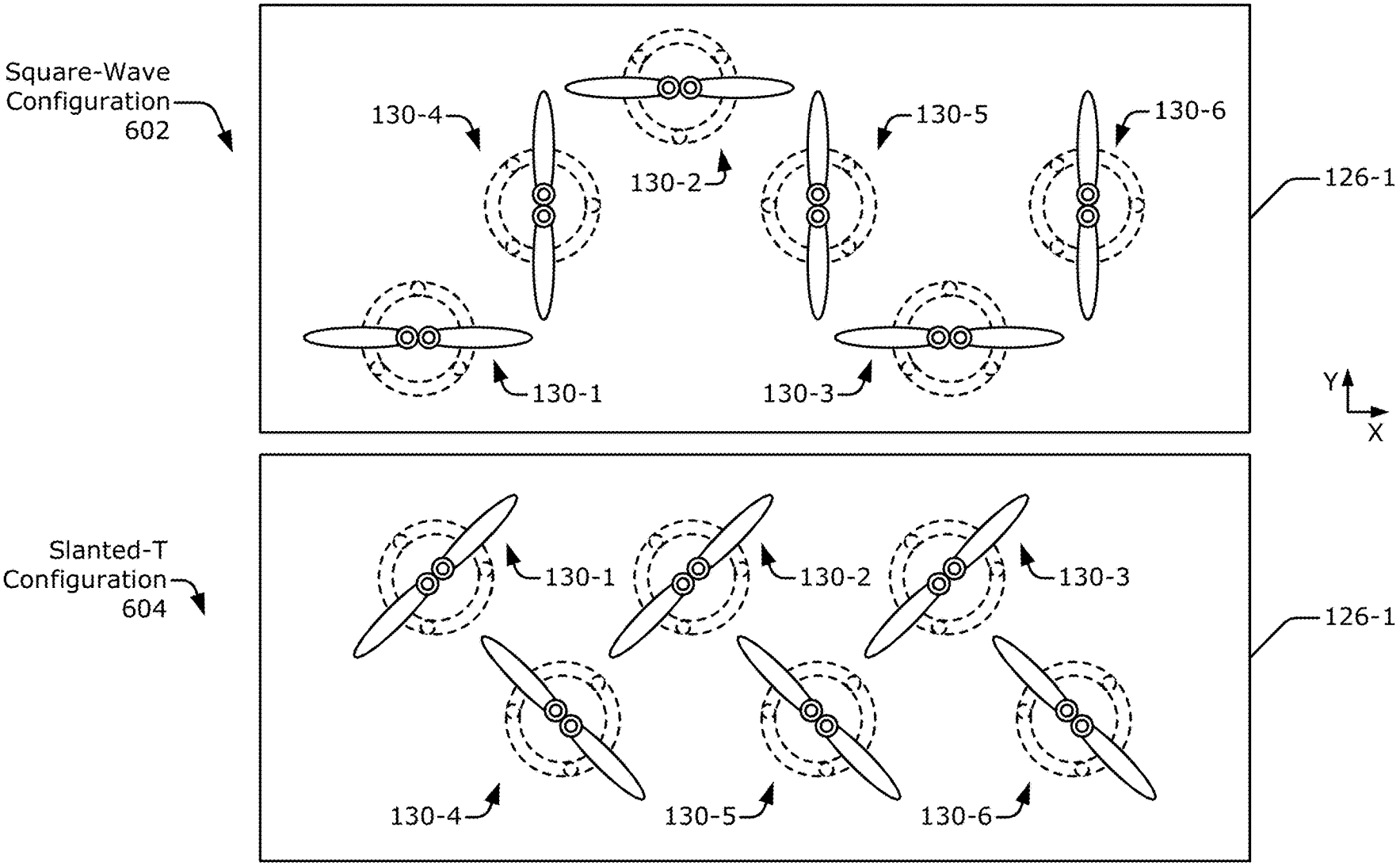
FIG. 6 illustrates other example configurations of antenna arrays including antenna assemblies with conductive cages.

FIG. 6 illustrates other example configurations 602 and 604 of antenna arrays 128-1 and 128-2 (of FIG. 5). In the configurations 602 and 604, the first polarization 506-1 is orthogonal to the second polarization 506-2 and the antenna assemblies 130-1 to 130-3 of the antenna array 128-1 are interleaved with the antenna assemblies 130-4 to 130-6 of the antenna array 128-2. Each of the antenna assemblies 130-1 to 130-6 include its own conductive cage 136. The conductive cages 136 isolate the antenna assemblies 130-1 to 130-6 from each other.

In the square-wave configuration 602, the radiating elements 132 of the antenna assemblies 130-1 to 130-3 are oriented along the horizontal X axis and the radiating elements 132 of the antenna assemblies 130-4 to 130-6 are oriented along the vertical Y axis. Adjacent ones of the antenna assemblies 130-1 to 130-3 are offset from each other along both the horizontal X axis and the vertical Y axis. Adjacent ones of the antenna assemblies 130-4 to 130-6 are offset from each other along at least the horizontal X axis. These offsets can be approximately equal to the length of the radiating elements 132. In this way, the antenna assemblies 130-1 to 130-6 form the shape of a square wave, as shown in FIG. 6.

In the slanted-T configuration 604, the radiating elements 132 of the antenna assemblies 130-1 to 130-3 are oriented along the negative 45 degree angle and the radiating elements 132 of the antenna assemblies 130-3 to 130-6 are oriented along the positive 45 degree angle. The antenna assemblies 130-1 to 130-3 are offset from the antenna assemblies 130-4 to 130-6 along the Y axis. In this way, pairs of the antenna assemblies 130-1 to 130-3 and the antenna assemblies 130-4 to 130-6 form a T-shape that is slanted along the negative 45 degree angle, as shown in FIG. 6. While an opening 206 within the ground plane 124 is not explicitly illustrated in FIGS. 5 and 6 for simplicity, it will be understood that each of the antenna assemblies 130-1 to 130-6 of FIGS. 5 and 6 may be disposed such that a conductive cage 136 thereof is distributed around a respective opening 206.

Figure 7:
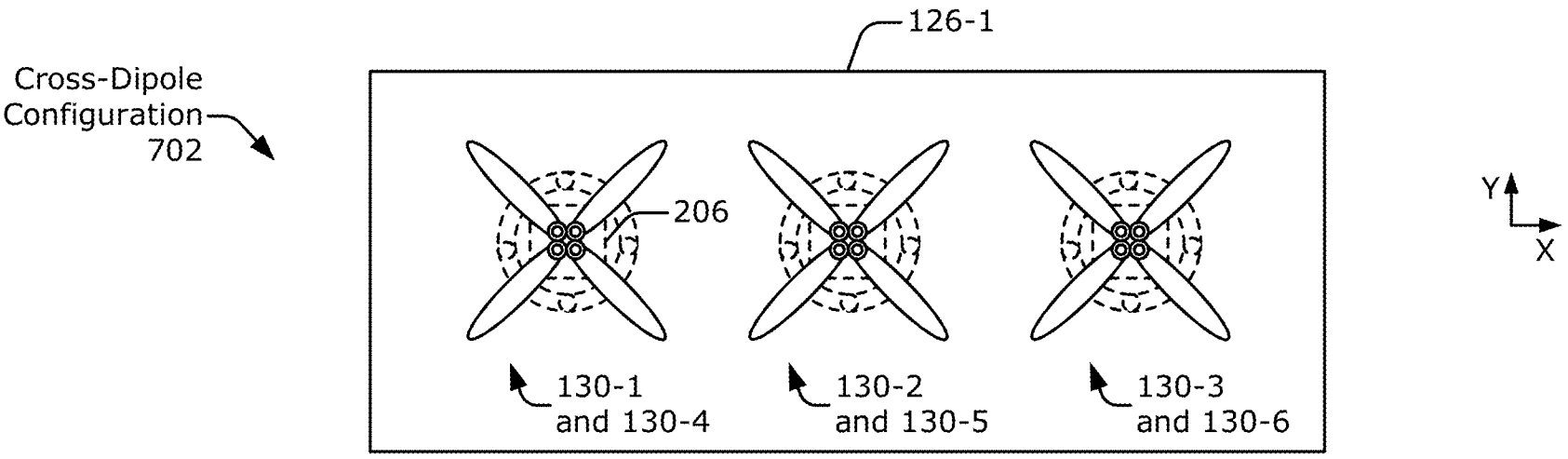
FIG. 7 illustrates yet another example configuration of an antenna array including antenna assemblies with conductive cages.

FIG. 7 illustrates yet another example configuration 702 of the antenna arrays 128-1 and 128-2 (of FIG. 5). In contrast to the configurations 502, 504, 602, and 604 of FIGS. 5 and 6, pairs of the antenna assemblies 130-1 to 130-6 across the antenna arrays 128-1 and 128-2 are implemented together such that they share a same opening 206 within the ground plane 124 and share a same conductive cage 136. For example, the antenna assemblies 130-1 and 130-4 share a same conductive cage 136. Similarly, the antenna assemblies 130-2 and 130-5 share another conductive cage 136 and the antenna assemblies 130-3 and 130-6 share yet another conductive cage 136. These pairs of antenna assemblies 130-1 to 130-6 form an "X," as shown in FIG. 7. In another implementation not explicitly shown, the pairs of antenna assemblies 130-1 to 130-6 can be rotated 45 degrees to form a cross shape.

During operation, the return currents within the feed vias 134-1 and 134-2 of each antenna assembly 130 flow into each other. Since the return current flows in the opposite feed via 134 of the antenna assembly 130, an electric field is not observed in the space between the feed vias 134 of the antenna assembly 130 and this space behaves like a virtual ground. In this way, the feed vias 134 for the antenna assembly 130-1 are within a virtual ground of the antenna assembly 130-4, and the feed vias 134 of the antenna assembly 130-4 are within a virtual ground of the antenna assembly 130-1. This inherent property enables the pairs of antenna assemblies 130-1 to 130-6 to have sufficient isolation while sharing the conductive cage 136.

Figure 8:
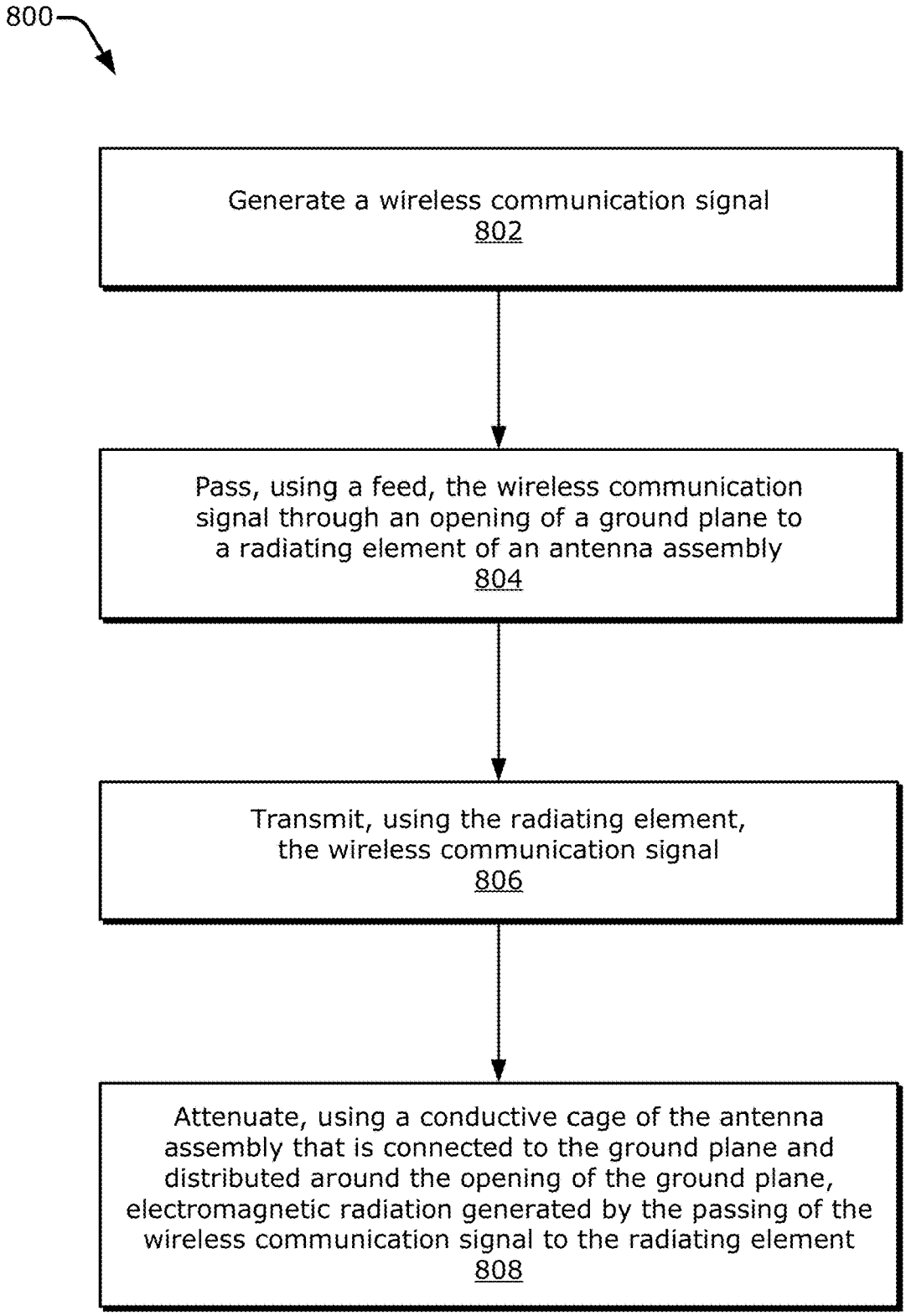
FIG. 8 is a flow diagram illustrating an example process for operating an antenna assembly with a conductive cage.

FIG. 8 is a flow diagram illustrating an example process 800 for operating an antenna with a conductive cage. The process 800 is described in the form of a set of blocks 802-808 that specify operations that can be performed. However, operations are not necessarily limited to the order shown in FIG. 8 or described herein, for the operations may be implemented in alternative orders or in fully or partially overlapping manners. Also, more, fewer, and/or different operations may be implemented to perform the process 800, or an alternative process. Operations represented by the illustrated blocks of the process 800 may be performed by the computing device 102 (e.g., of FIG. 1) or antenna circuitry 122 (e.g., of FIG. 1). More specifically, at least a portion of the operations of the process 800 may be performed by an antenna assembly 130, as shown in FIG. 2, 3, or 4.

At block 802, a wireless communication signal is generated. For example, the wireless transceiver 120 of the computing device 102 generates the wireless communication signal, as described above with respect to FIG. 1. The transmission line 208 (of FIG. 2) can pass the wireless communication signal from the wireless transceiver 120 to the antenna circuitry 122.

At block 804, the wireless communication signal is passed through an opening of a ground plane to a radiating element of an antenna assembly using a feed. For example, the feed via 134-1 or 134-2 of FIG. 2 passes the wireless communication signal through the opening 206 within the ground plane 124 to the radiating element 132-1 or 132-2 of the antenna assembly 130.

At block 806, the wireless communication signal is transmitted using the radiating element. For example, the radiating element 132-1 or 132-2 of the antenna assembly 130 transmits the wireless communication signal. The radiating element 132-1 or 132-2 may be implemented on an upper dielectric layer 126 of the antenna circuitry 122, such as the top dielectric layer 126-1 as shown in FIG. 2. The antenna assembly 130 can be implemented using any of the antenna assemblies 130 described above with respect to FIGS. 2 to 4.

At block 808, electromagnetic radiation generated by the passing of the wireless communication signal is attenuated using a conductive cage of the antenna assembly that is connected to the ground plane and distributed around the opening of the ground plane. The attenuating may be effective to substantially isolate the antenna assembly from an adjacent antenna assembly. For example, the conductive cage 136 substantially attenuates the electromagnetic radiation generated by the feed via 134-1 or 134-2, which passes the wireless communication signal to the corresponding radiating element 132-1 or 132-2. In particular, the conductive cage 136 generates an opposing magnetic field, which attenuates the magnetic field generated by the feed via 134-1 or 134-2. By attenuating the electromagnetic radiation, the conductive cage 136 suppresses the coupling between the antenna assembly 130 and other adjacent antenna assemblies within the antenna circuitry 122.

The conductive cage 136 is connected to the ground plane 124 and is distributed around the opening 206 of the ground plane 124, as shown in FIG. 2. For example, the ground vias 210-1 to 210-3 of the conductive cage 136 can be evenly or unevenly distributed around a center of the opening 206. Lengths of the ground vias 210-1 to 210-3 extend between the ground plane 124 and another dielectric layer that is below the top dielectric layer 126-1, as shown in FIG. 2. The conductive cage 136 may isolate the antenna assembly 130 from an adjacent antenna assembly 130 that is within the antenna array 128. The antenna array 128 can include any of the antenna arrays 128 shown in FIGS. 5 to 7.

Unless context dictates otherwise, use herein of the word "or" may be considered use of an "inclusive or," or a term that permits inclusion or application of one or more items that are linked by the word "or" (e.g., a phrase "A or B" may be interpreted as permitting just "A," as permitting just "B," or as permitting both "A" and "B"). Further, items represented in the accompanying figures and terms discussed herein may be indicative of one or more items or terms, and thus reference may be made interchangeably to single or plural forms of the items and terms in this written description. Finally, although subject matter has been described in language specific to structural features or methodological operations, it is to be understood that the subject matter defined in the appended claims is not necessarily limited to the specific features or operations described above, including not necessarily being limited to the organizations in which features are arranged or the orders in which operations are performed.

What is claimed is:

1. An apparatus comprising:

a ground plane having at least one opening; and at least one antenna assembly comprising:

at least one radiating element implemented on a first plane that is substantially parallel to the ground plane;

at least one feed via connected to the at least one radiating element, the at least one feed via configured to connect to at least one transmission line through the at least one opening;

a conductive cage comprising at least three ground vias connected to the ground plane at positions that are distributed around the at least one opening, lengths of the at least three ground vias extending a portion of a distance between the ground plane and the at least one radiating element; and at least one shorting strip connected between the conductive cage and the at least one feed via.

2. The apparatus of claim 1, wherein:

the conductive cage comprises at least one ground ring implemented on a second plane that is substantially parallel to both the first plane and the ground plane, the second plane positioned between the first plane and the ground plane; and the at least three ground vias are connected between the ground plane and the at least one ground ring.

3. The apparatus of claim 2, wherein the at least one ground ring is in the form of one of the following shapes:

a polygon; or a circle.

4. The apparatus of claim 2, wherein a horizontal distance between a center of the at least one opening within the ground plane and an outer edge of the at least one ground ring is less than a length of the at least one radiating element.

5. The apparatus of claim 2, wherein:

the at least one ground ring comprises:

a first ground ring implemented on the second plane; and a second ground ring implemented on a third plane that is substantially parallel to the second plane, the first plane, and the ground plane; the third plane positioned between the first plane and the second plane; and the conductive cage comprises at least three other ground vias connected between the first ground ring and the second ground ring.

6. The apparatus of claim 5, wherein:

the first ground ring has a circular shape with a first diameter;

the second ground ring has another circular shape with a second diameter; and the second diameter is smaller than the first diameter.

7. The apparatus of claim 5, wherein the first ground ring and the second ground ring have a same diameter.

8. The apparatus of claim 2, further comprising:

multiple dielectric layers that are substantially parallel to the ground plane, the multiple dielectric layers comprising:

a first dielectric layer, a surface of the first dielectric layer implemented on the first plane; and a second dielectric layer, a surface of the second dielectric layer implemented on the second plane, wherein:

the second dielectric layer is positioned between the ground plane and the first dielectric layer;

the at least one radiating element is implemented on the first dielectric layer; and the at least one ground ring is implemented on the second dielectric layer.

9. The apparatus of claim 2, wherein the at least one shorting strip is connected between the at least one ground ring and the at least one feed via.

10. The apparatus of claim 1, wherein:

the at least three ground vias are connected between the ground plane and a second plane that is substantially parallel to both the first plane and the ground plane, the second plane positioned between the first plane and the ground plane;

the at least one antenna assembly further comprises at least one parasitic element implemented on a third plane that is substantially parallel to the second plane, the first plane, and the ground plane;

the third plane is positioned between the second plane and the first plane; and the at least one parasitic element is not directly connected to the at least one feed via.

11. The apparatus of claim 1, wherein:

the at least three ground vias are connected between the ground plane and a second plane that is substantially parallel to both the first plane and the ground plane, the second plane positioned between the first plane and the ground plane;

the at least one antenna assembly further comprises at least one driven element implemented on a third plane that is substantially parallel to the second plane, the first plane, and the ground plane;

the third plane is positioned between the second plane and the first plane; and the at least one driven element is connected to the at least one feed via.

12. The apparatus of claim 1, further comprising:

a wireless transceiver coupled to the at least one feed via of the at least one antenna assembly;

a display screen; and a processor operatively coupled to the display screen and the wireless transceiver, the processor is configured to present one or more graphical images on the display screen based on signals communicated by the wireless transceiver using the at least one antenna assembly.

13. The apparatus of claim 1, wherein the at least three ground vias are evenly distributed around a center of the at least one opening of the ground plane.

14. The apparatus of claim 1, wherein:

the at least one transmission line comprises a first transmission line and a second transmission line;

the at least one radiating element comprises a first radiating element and a second radiating element; and the at least one feed via comprises:

a first feed via connected to the first radiating element, the first feed via configured to connect to the first transmission line through the at least one opening; and a second feed via connected to the second radiating element, the second feed via configured to connect to the second transmission through the at least one opening.

15. The apparatus of claim 14, wherein the first radiating element and the second radiating element are configured in a bowtie shape.

16. The apparatus of claim 14, wherein:

the at least one transmission line comprises a third transmission line and a fourth transmission line;

the at least one radiating element comprises a third radiating element and a fourth radiating element; and the at least one feed via comprises:

a third feed via connected to the third radiating element, the third feed via configured to connect to the third transmission line through the at least one opening; and a fourth feed via connected to the fourth radiating element, the fourth feed via configured to connect to the fourth transmission line through the at least one opening.

17. The apparatus of claim 16, wherein the at least one antenna assembly implements a cross-dipole antenna.

18. The apparatus of claim 1, further comprising:

multiple dielectric layers that are vertically stacked in relation to the ground plane, the multiple dielectric layers comprising a first dielectric layer and a second dielectric layer, the second dielectric layer positioned between the ground plane and the first dielectric layer, wherein:

the at least one opening comprises multiple openings;

the at least one antenna assembly comprises multiple antenna assemblies;

the at least one radiating element of each antenna assembly is implemented on the first dielectric layer;

the at least one feed via of each antenna assembly passes through one of the multiple openings and the second dielectric layer;

the conductive cage of each antenna assembly is implemented within the second dielectric layer; and the conductive cage of each antenna assembly is configured to suppress coupling between the at least one feed via and other feed vias associated with other antenna assemblies of the multiple antenna assemblies.

19. The apparatus of claim 18, wherein the at least three ground vias of each conductive cage are implemented within the second dielectric layer.

20. The apparatus of claim 18, further comprising:

a first antenna array having a first polarization, the first antenna array comprising a first set of antenna assemblies of the multiple antenna assemblies; and a second antenna array having a second polarization, the second antenna array comprising a second set of antenna assemblies of the multiple antenna assemblies, wherein the first polarization is orthogonal to the second polarization.

21. The apparatus of claim 20, wherein antenna assemblies of the first set of antenna assemblies are interleaved with antenna assemblies of the second set of antenna assemblies along an axis.

22. The apparatus of claim 21, wherein:

corresponding radiating elements of the first set of antenna assemblies have an orientation that is parallel to the axis, and corresponding radiating elements of the second set of antenna assemblies have an orientation that is perpendicular to the axis; or the corresponding radiating elements of the first set of antenna assemblies have another orientation that is offset from the axis by positive 45 degrees, and the corresponding radiating elements of the second set of antenna assemblies have another orientation that is offset from the axis by negative 45 degrees.

23. The apparatus of claim 20, wherein:

antenna pairs of the first set of antenna assemblies and the second set of antenna assemblies form cross-dipole antennas; and each respective antenna pair of the antenna pairs from the first set of antenna assemblies and the second set of antenna assemblies share a respective single conductive cage.

24. An apparatus comprising:

grounding means for providing a connection to a ground, the grounding means comprising at least one opening; and communication means for transmitting or receiving a wireless communication signal, the communication means comprising:

four radiating means for converting between an electrical signal and electromagnetic energy, the electrical signal and the electromagnetic energy associated with the wireless communication signal;

four feeding means for passing the electrical signal through the at least one opening of the grounding means and through multiple dielectric layers of the communication means, each of the four feeding means connected to a respective one of the four radiating means; and conductive means for attenuating electromagnetic radiation generated by the four feeding means, the conductive means distributed around the at least one opening and implemented within a portion of the multiple dielectric layers, the conductive means connected to the grounding means.

25. The apparatus of claim 24, wherein the communication means comprises shorting means for connecting at least two of the four feeding means to the conductive means.

26. The apparatus of claim 24, wherein the communication means comprises parasitic means for responding to the electromagnetic energy, the parasitic means positioned between the conductive means and the four radiating means.

27. The apparatus of claim 24, wherein the communication means comprises driven means for converting between the electrical signals and the electromagnetic energy, the driven means connected to the four feeding means and positioned between the conductive means and the four radiating means.

28. A method comprising:

generating wireless communication signals;

passing, using feeds, the wireless communication signals through an opening of a ground plane to radiating elements of a pair of antenna assemblies, the pair of antenna assemblies implementing a cross-dipole antenna;

transmitting, using the radiating elements, the wireless communication signals; and attenuating, using a conductive cage of the pair of antenna assemblies that is connected to the ground plane and distributed around the opening of the ground plane, electromagnetic radiation generated by the passing of the wireless communication signals to the radiating elements.

29. The method of claim 28, wherein the conductive cage comprises at least four ground vias having heights that extend a portion of a vertical distance between the ground plane and the radiating elements.

30. The method of claim 29, wherein:

the radiating elements are implemented on a first dielectric layer that is substantially parallel to the ground plane;

the conductive cage comprises at least one ground ring implemented on a second dielectric layer that is substantially parallel to the ground plane and the first dielectric layer, the second dielectric layer positioned between the first dielectric layer and the ground plane; and the at least four ground vias are connected between the ground plane and the at least one ground ring.

* * * * *